US006866221B2

(12) United States Patent
Federici et al.

(10) Patent No.: US 6,866,221 B2
(45) Date of Patent: Mar. 15, 2005

(54) STRIP FEED UNIT AND METHOD, AND REEL END PICKUP METHOD

(75) Inventors: Luca Federici, Bologna (IT); Salvatore Carboni, Bologna (IT); Fiorenzo Draghetti, Medicina (IT)

(73) Assignee: G. D Societa' per Azioni, Bologna (IT)

( * ) Notice: Subject to any disclaimer, the term of this patent is extended or adjusted under 35 U.S.C. 154(b) by 53 days.

(21) Appl. No.: 10/311,407

(22) PCT Filed: Jun. 26, 2001

(86) PCT No.: PCT/IT01/00330

§ 371 (c)(1),
(2), (4) Date: Jul. 3, 2003

(87) PCT Pub. No.: WO02/00536

PCT Pub. Date: Jan. 3, 2002

(65) Prior Publication Data

US 2004/0035975 A1 Feb. 26, 2004

(30) Foreign Application Priority Data

Jun. 29, 2000 (IT) ..... BO2000A0377

(51) Int. Cl.[7] ..... B65H 19/14; B65H 19/18; B65H 19/20

(52) U.S. Cl. ..... 242/552; 242/553; 242/554.1; 242/554.2; 242/556; 242/562.1

(58) Field of Search ..... 242/552, 553, 242/554.1, 554.2, 556, 562, 562.1; 156/502, 504

(56) References Cited

U.S. PATENT DOCUMENTS

| | | | | | |
|---|---|---|---|---|---|
| 4,646,986 | A | | 3/1987 | Heitmann | |
| 4,984,750 | A | * | 1/1991 | Shigeta et al. | 242/553 |
| 5,397,424 | A | * | 3/1995 | Sakano et al. | 242/562 |
| 5,487,805 | A | * | 1/1996 | Boriani et al. | 242/554.2 |
| 5,518,202 | A | * | 5/1996 | Focke et al. | 242/552 |
| 6,142,408 | A | * | 11/2000 | Focke et al. | 242/553 |
| 6,328,088 | B1 | * | 12/2001 | Draghetti | 242/552 |

FOREIGN PATENT DOCUMENTS

| | | |
|---|---|---|
| EP | 0539983 | 5/1993 |
| EP | 0940360 | 9/1999 |

* cited by examiner

*Primary Examiner*—John M. Jillions
(74) *Attorney, Agent, or Firm*—Ladas & Parry LLP

(57) ABSTRACT

A unit (1) for feeding strips (2, 3) has pins (12) supporting a first and a second reel (6, 7) of a first and a second strip (2, 3) respectively; the second reel (7) having an end (53; 56) of the second strip (3) extending at the cylindrical outer surface (52) of the second reel (7); the unit having a tool (18) having a plate (40) for joining the first and the second strip (2, 3), and a movable arm (20) having a gripping head (25; 55) for gripping the end (53; 56) along the cylindrical outer surface (52); and the gripping head (25; 55) having a first gripping face (30; 60) for gripping the first and the second strip (2, 3) between the plate (40) of the tool (18) and the first gripping face (30; 60).

30 Claims, 6 Drawing Sheets

10
9
15
14
16
M
13
12
6
4
50
50
11
5
2
51
41
18
50
25
30
32
33
31
26
17
3
44
13
12
20
43
46
7
29
19
1
8
42
45
28
23
24
27
21
7
52
54
54
53

STRIP FEED UNIT AND METHOD, AND REEL END PICKUP METHOD

TECHNICAL FIELD

The present invention relates to a strip feed unit.

BACKGROUND ART

Strip feed units are widely used in the packaging industry, and are normally installed on and for feeding strips of packaging material to automatic machines. A strip feed unit normally comprises two pins, each for supporting a respective reel of strip material; and a splicing device for joining the strips on the reels, as the strip on one reel is about to run out, and so ensuring continuous supply of the packaging material. In other words, as a first strip is unwound off one of the two reels, the end of the strip on the other reel is detached from the reel, and a portion of the strip is positioned at the splicing device to join the two strips.

In one known type of strip feed unit, the operator detaches the end of the strip on the new reel and positions a portion of the strip at the splicing device, so that the operator not only runs the risk of injury by working on an automatic machine while it is running, but is also called upon to monitor the reels continuously to prevent any distraction resulting in stoppage of the machine.

To eliminate the above drawbacks, another type of strip feed unit has been proposed in which the operator is replaced by an automatic transfer device for picking up and transferring the end of the strip on the reel to the strip splicing device.

Though successful in eliminating safety hazards and continuous monitoring by the operator, strip feed units of the above type are so complex as to be unsuitable for actual installation on automatic machines.

DISCLOSURE OF INVENTION

It is an object of the present invention to provide a strip feed unit designed to eliminate the aforementioned drawbacks.

According to the present invention, there is provided a strip feed unit comprising pins for supporting a first and a second reel of a first and a second strip respectively, the second reel having a cylindrical outer surface, and an end of the second strip extending at said cylindrical outer surface; the unit comprising a movable arm having a gripping head for gripping said end along the cylindrical outer surface, and a first tool having a plate for joining the first and the second strip; and the unit being characterized in that said gripping head comprises a first gripping face for gripping said first and said second strip between the plate and said first gripping face.

The unit according to the present invention is simplified by one gripping head both picking up the end of the strip and cooperating with the tool to join the first and the second strip.

The present invention also relates to a method of feeding strips to an automatic machine.

According to the present invention, there is provided a method of feeding strips to an automatic machine by means of a unit comprising pins for supporting a first and a second reel of a first and a second strip, the second reel having a cylindrical outer surface, and an end of said second strip extending at said cylindrical outer surface; an arm having a gripping head; and a first tool having a plate for joining the first and the second strip; the method being characterized by comprising the steps of positioning said gripping head in contact with said end; picking up said second strip by means of said gripping head; and gripping the first and the second strip between the plate of said first tool and said gripping head.

BRIEF DESCRIPTION OF THE DRAWINGS

A number of non-limiting embodiments of the present invention will be described by way of example with reference to the accompanying drawings, in which:

FIG. 1*b* shows an enlarged detail of a new reel of strip material installed on the FIG. 1 unit;

BEST MODE FOR CARRYING OUT THE INVENTION

Figure 1:
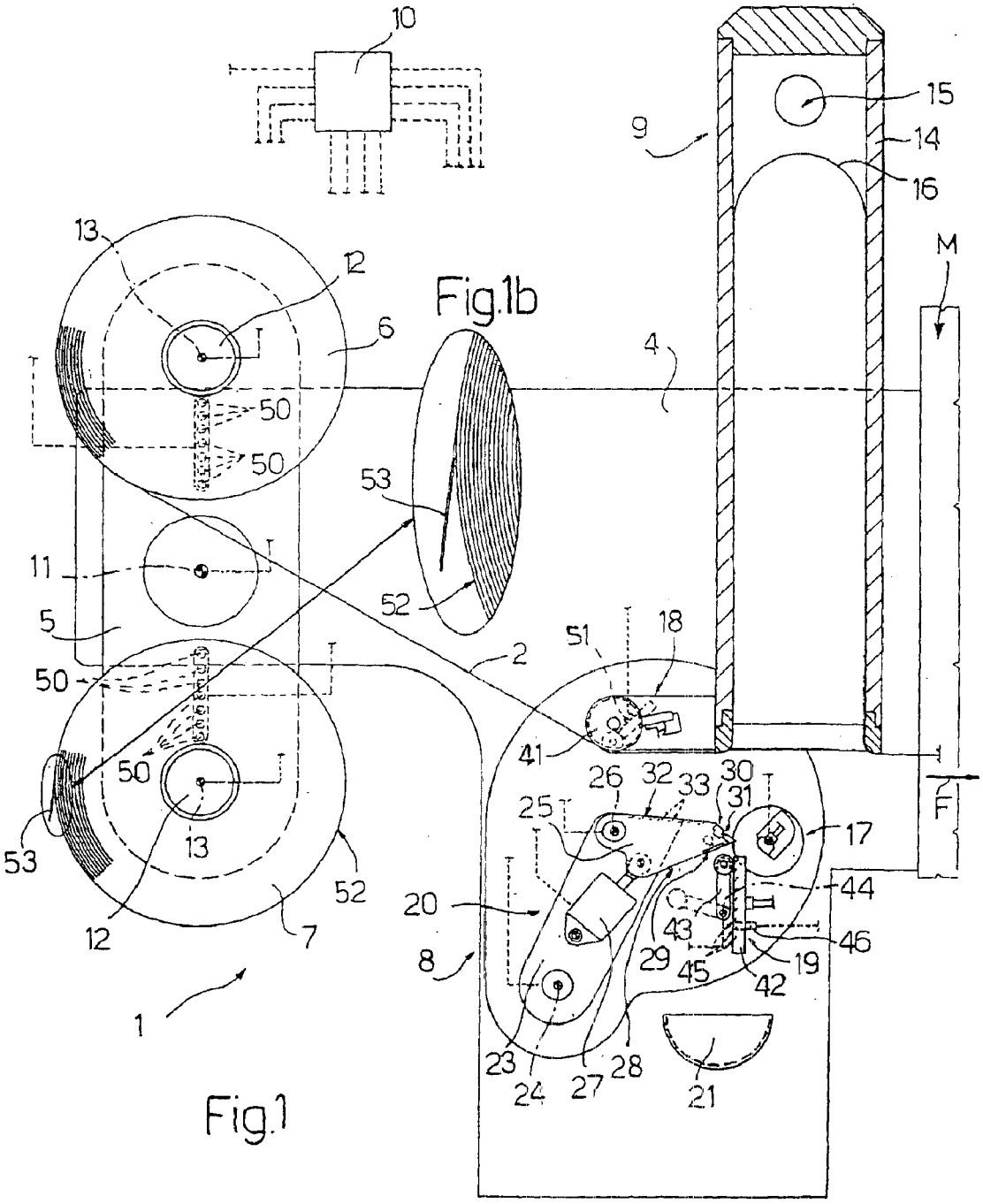
FIG. 1 shows a side view, with parts removed for clarity, of a strip feed unit in accordance with the present invention.

Number 1 in FIG. 1 indicates as a whole a unit for feeding strips 2 and 3 to an automatic machine for packaging products not shown. Unit 1 is installed on automatic machine M and comprises a frame 4; a platform 5 for supporting reels 6 and 7; a splicing device 8 for joining strips 2 and 3; and a compensating store 9. Unit 1 is controlled by a control unit 10 connected to a control unit of automatic machine M.

Strips 2 and 3 are fed to automatic machine M one at a time, and are joined when reel 6 begins running out. In the following description, 2 refers to the strip fed to machine M and unwound off reel 6; and 3 refers to the strip unwound off reel 7 for splicing to strip 2. Reel 6 is therefore also referred to as the run-out reel, and reel 7 as the new reel. Though indicated using different reference numbers, strips 2 and 3 and reels 6 and 7 have the same characteristics in terms of size and material, which, in the embodiment shown, comprises heat-seal material.

Platform 5 is fitted to frame 4 to rotate about an axis 11 perpendicular to the FIG. 1 plane, and comprises two pins 12 diametrically opposite with respect to axis 11 and rotating about respective axes 13 parallel to axis 11. Platform 5 and pins 12 are rotated about respective axes 11 and 13 by means of respective actuators (not shown) and by means of signals supplied by control unit 10.

Compensating store 9 comprises a substantially rectangular-section tube 14 closed at one end and having a mouth 15 through which a suction source (not shown) generates a vacuum to draw strip 2 inside tube 14 and form a loop 16 of strip 2, which is used up when joining strips 2 and 3 as described in detail later on. In general, the position of loop 16 inside tube 14 varies according to the feed speed of strip 2 up- and downstream from store 9.

Splicing device 8 comprises a cutting tool 17 for cutting strip 3; a cutting and sealing tool 18 for cutting strip 2 and joining strips 2 and 3; an adjusting device 19 for adjusting the position of strip 3; an arm 20 for picking up and transferring strip 3 from the new reel 7 to cutting tools 17 and 18; and a bin 21 for the cut-off portions 22 of strip 3.

Arm 20 is an articulated arm, and comprises a crank 23 rotating with respect to frame 4 about an axis 24 perpendicular to the FIG. 1 plane; and a gripping head 25 rotating with respect to crank 23 about an axis 26 parallel to axis 24. Crank 23 is rotated between two work positions about respective axis 24 by an actuator (not shown) operated by control unit 10, and head 25 is rotated between two work positions about axis 26 by an actuator 27 operated by control unit 10. Head 25 comprises a gripping face 28 having suction holes 29; a cutting face 30 having a groove 31 and cooperating with tools 17 and 18; and a face 32 along which oriented holes 33 are distributed. Face 30 is adjacent to face 28 on one side and to face 32 on the opposite side, and forms an acute angle with face 28, and an obtuse angle with face 32.

Figure 3:
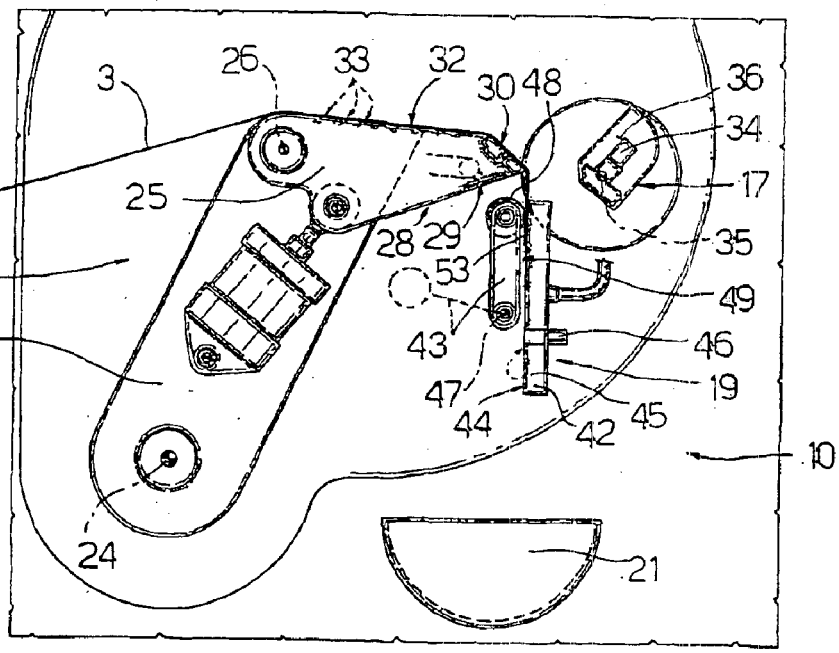

With reference to FIG. 3, cutting tool 17 comprises an arm 34 rotating with respect to frame 4 about a respective axis 35 parallel to axis 24; and a heatable edge 36 for cutting strip 3. Arm 34 is movable between the rest position shown in FIG. 3 and the work position shown in FIG. 4; and edge 36 extends perpendicularly to the FIG. 3 plane, to a length greater than the width of strip 3.

Figure 5:
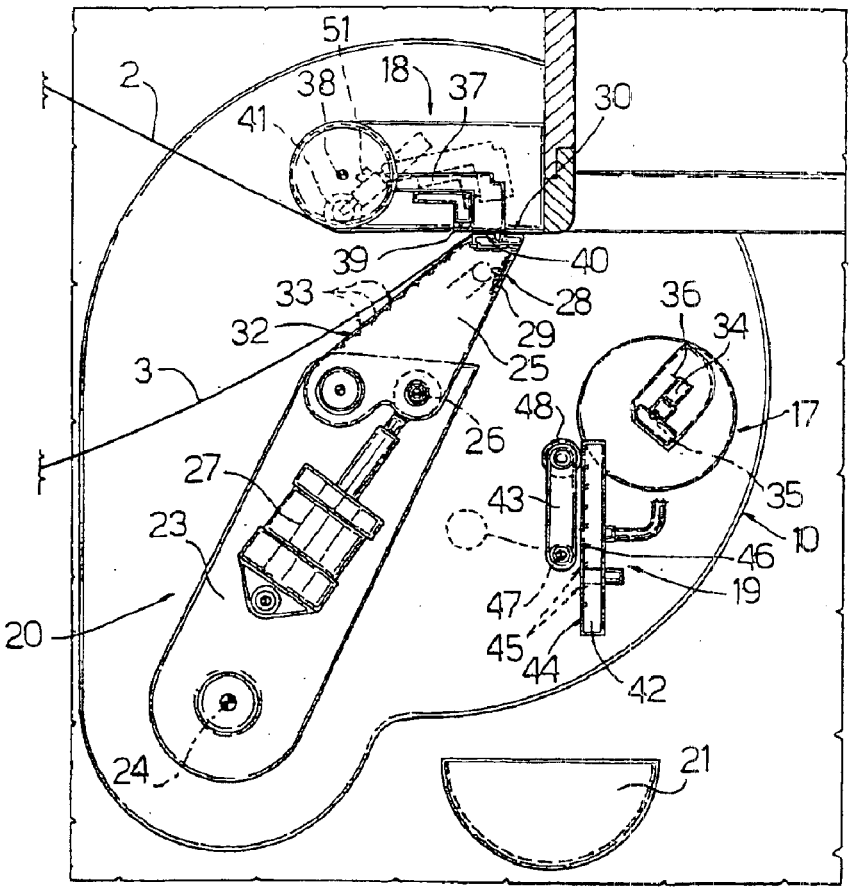

With reference to FIG. 5, tool 18 comprises an arm 37 rotating with respect to frame 4 about an axis 38 parallel to axis 24; a heatable edge 39 for cutting strip 2; and a sealing plate 40. In FIG. 5, arm 37 is shown by the continuous line in the work position, and by the dash line in the rest position. Edge 39 and plate 40 are movable with respect to each other so as to act on strip 2 at different times. At tool 18, device 8 comprises a guide roller 41 for guiding strip 2 to tool 18. Edge 39 extends perpendicularly to the FIG. 5 plane, to a length greater than the width of strip 2; and tools 17 and 18 are moved between the respective rest positions and work positions by two respective actuators (not shown) controlled by control unit 10.

With reference to FIG. 3, adjusting device 19 comprises a wall 42; and an arm 43 movable between a work position and a rest position shown by the dash line in FIG. 3. Wall 42 comprises a flat face 44 along which oriented holes 45 and optical sensors 46 are distributed; arm 43 is mounted to rotate about an axis 47 perpendicular to the FIG. 3 plane, and has one end fitted with a roller 48; and, in the work position, arm 43 is substantially parallel to face 44 of wall 42 to form a feed channel 49 for strip 3.

With reference to FIG. 1, control unit 10 transmits control signals to the actuators of platform 5, to pins 12, to arms 20, 34, 37, 43, to gripping head 25, and to heatable edges 36 and 39; is connected to sensors 46, to sensors 50 on platform 5 for determining the diameters of reels 6 and 7, and to sensors 51 at guide roller 41; and controls suction through holes 29, and air input through holes 33 and 45.

Figures 6, 7:
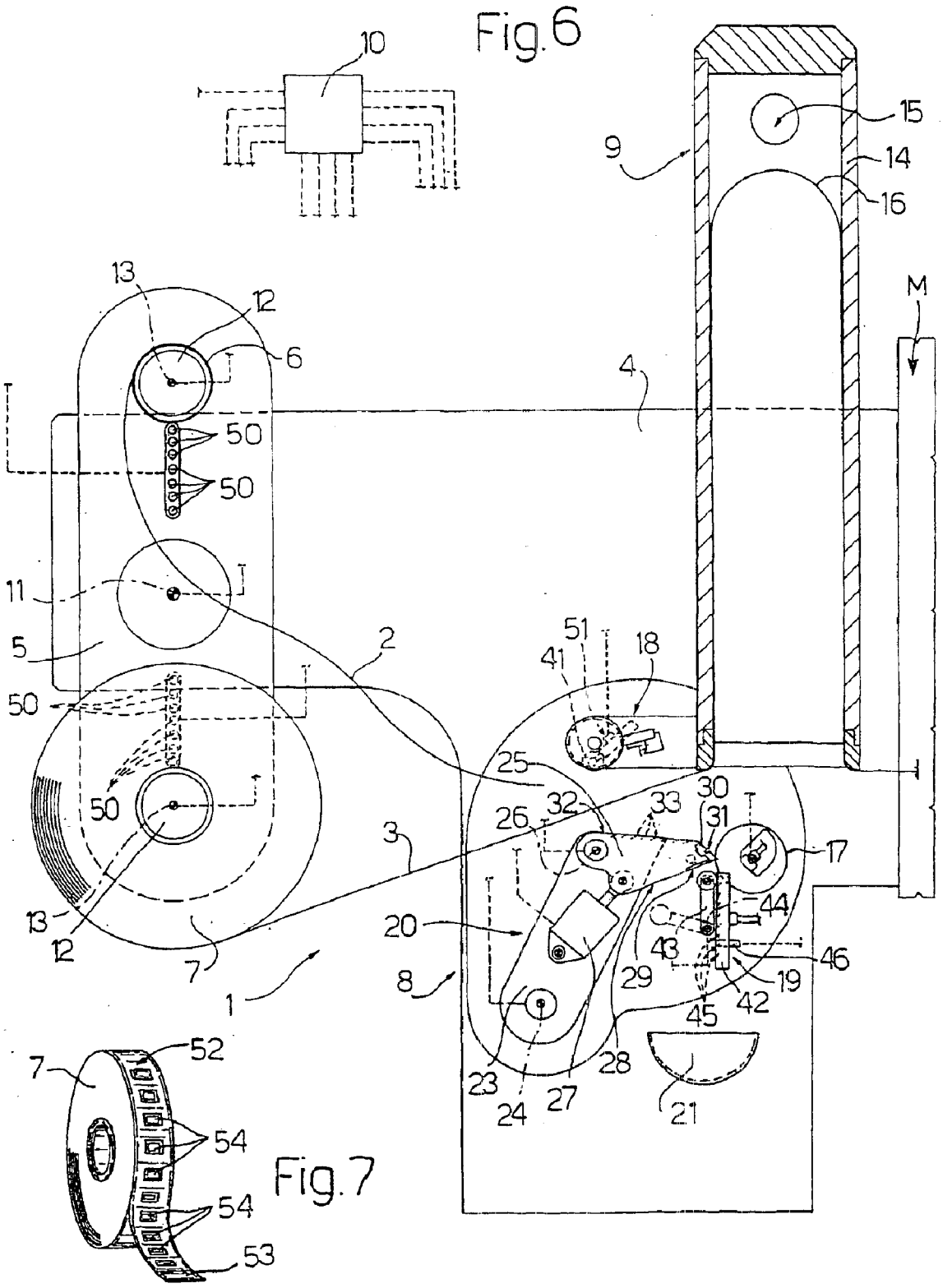
FIG. 6 shows a side view, with parts removed for clarity, of the FIG. 1 unit at a further operating step.
FIG. 7 shows a view in perspective of a reel with a portion of strip partly unwound.

With reference to FIG. 1, the new reel 7 has strip 3 wound completely so as to comprise a cylindrical surface 52 along which extends a ballasted free end 53 of strip 3. With reference to FIG. 7, strip 3 comprises graphic marks 54 equally spaced along strip 3; and the same equally spaced graphic marks 54 are also provided on strip 2.

In actual use, and with reference to FIG. 1, unit 1 feeds strip 2 unwound off reel 6 to automatic machine M. Pin 12 supporting reel 6 is rotated anticlockwise to unwind strip 2, which is deviated by guide roller 41 and directed to machine M in the direction of arrow F. As strip 2 is being unwound off reel 6, a new reel 7 is loaded onto pin 12 beneath reel 6.

Figure 2:
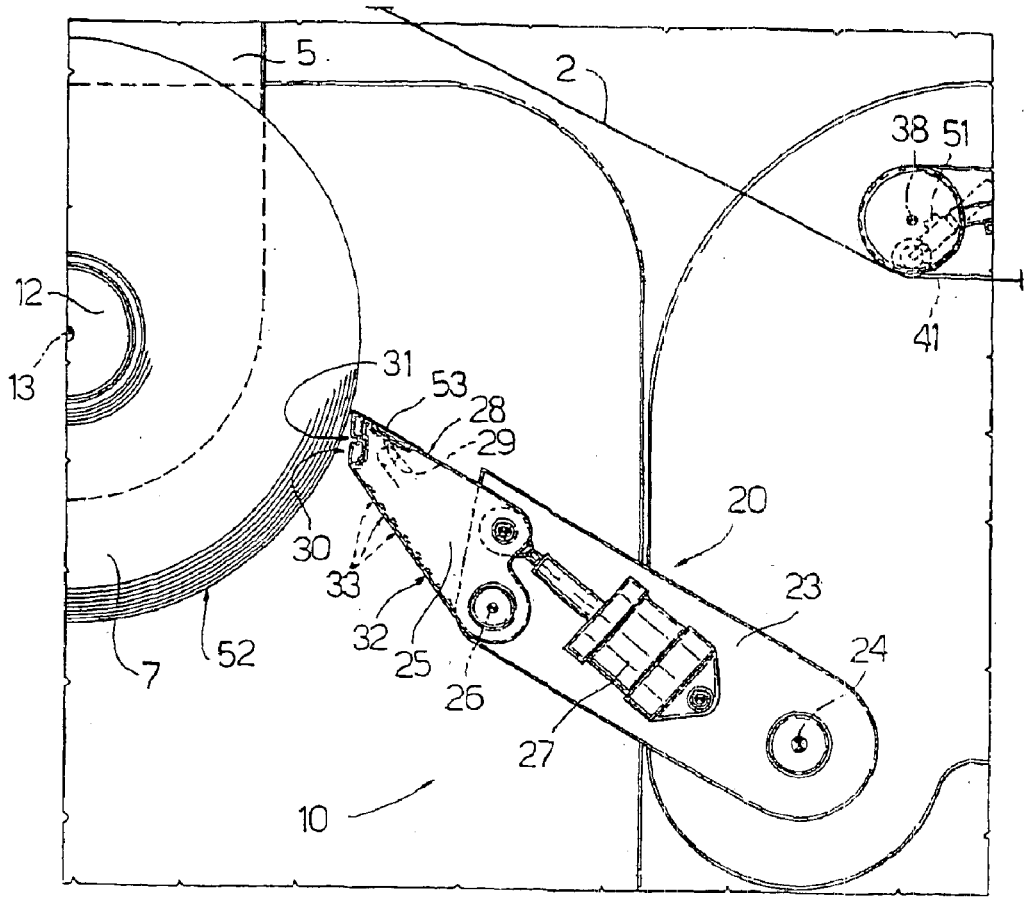
FIGS. 2 to 5 show small-scale side views, with parts removed for clarity, of details of the FIG. 1 unit at various operating steps.

With reference to FIG. 2, arm 20 is rotated anticlockwise, i.e. crank 23 and head 25 are rotated anticlockwise about respective axes 24 and 26, to position head 25 along surface 52 of the new reel 7, which is rotated clockwise about axis 13 of pin 12. As reel 7 rotates, the ballasted end 53 is intercepted by head 25 and, rocked by the rotation of reel 7, comes to rest by force of gravity on gripping face 28 where it is retained by suction holes 29. A vacuum gauge (not shown) detects a variation in pressure along the conduit (not shown) connected to holes 29, so that control unit 10 emits a signal to stop rotation of the new reel 7.

With reference to FIG. 3, crank 23 and head 25 are rotated clockwise about respective axes 24 and 26, while reel 7 is rotated anticlockwise about axis 13 to unwind strip 3. At this stage, arm 43 is rotated into the position shown by the dash line, and suction through holes 29 is cut off (air is also blown through holes 29) so that the ballasted end 53 is located close to wall 42. Arm 43 is then restored to the position shown by the continuous line in FIG. 3, and strip 3 is fed so that the ballasted end 53 is fed downwards inside channel 49.

Figure 4:
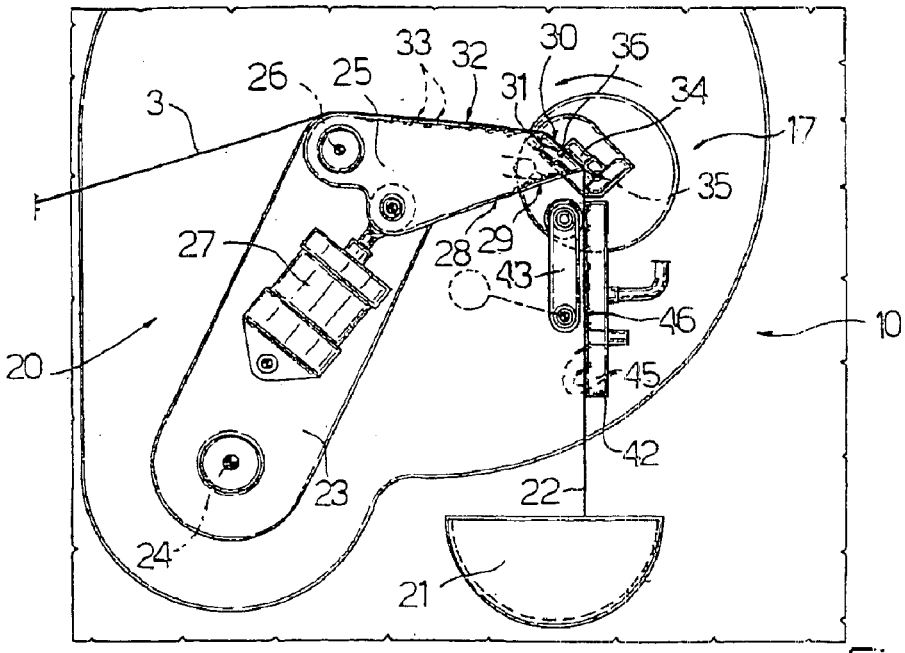

With reference to FIG. 4, reel 7 is rotated anticlockwise, while compressed air is blown through oriented holes 33 and 45 to feed strip 3 forward. That is, the anticlockwise rotation of reel 7 and the air through oriented holes 33 and 45 eliminate any resistance to the slight pull exerted by the weight of ballasted end 53. As strip 3 is fed slowly through channel 49, sensors 46 detect given reference points defined by graphic marks 54 on strip 3; and, upon sensors 46 detecting a given reference, the rotation of reel 7 is stopped and tool 17 is operated to cut the strip portion 22 comprising end 53.

With reference to FIG. 4, portion 22 is cut by rotating arm 34 anticlockwise about axis 35 to position edge 36 inside groove 31, burn strip 3, and so detach portion 22 which is collected in bin 21. Strip 3 at this point has one end resting on face 30, and is retained on face 30 by means of suction holes not shown.

Upon sensors 50 detecting reel 6 is about to run out, and sensors 51 detecting given points of graphic marks 54, control unit 10 reduces the feed speed of the strip downstream from compensating store 9 so as to fill store 9 completely, and then stops rotation of reel 6. With reference to FIG. 5, head 25 is rotated anticlockwise about axis 26 to position strip 3 substantially in contact with strip 2. At this stage, automatic machine M continues receiving strip 2 from store 9, while strips 2 and 3 are gripped between face 30 and plate 40, and edge 39 is moved with respect to plate 40 and cuts strip 2 at a point between plate 40 and reel 6. Plate 40 is heated by resistors (not shown) housed inside arm 37 to seal strips 2 and 3, which are thus spliced in time with each other without cutting off packaging material supply to automatic machine M, as shown in FIG. 6. Platform 5 is then rotated 180° to move reel 7 into the position previously occupied by reel 6.

In a variation not shown, the packaging material is defined by a strip of paper, edges 36, 39 and groove 31 are replaced by knives, and the splicing device comprises a gumming device located along the path of head 25.

In a variation not shown, strips 2 and 3 have no graphic marks, and splicing of the strips is simplified by not requiring that the strips be spliced in time with each other.

Figure 8:
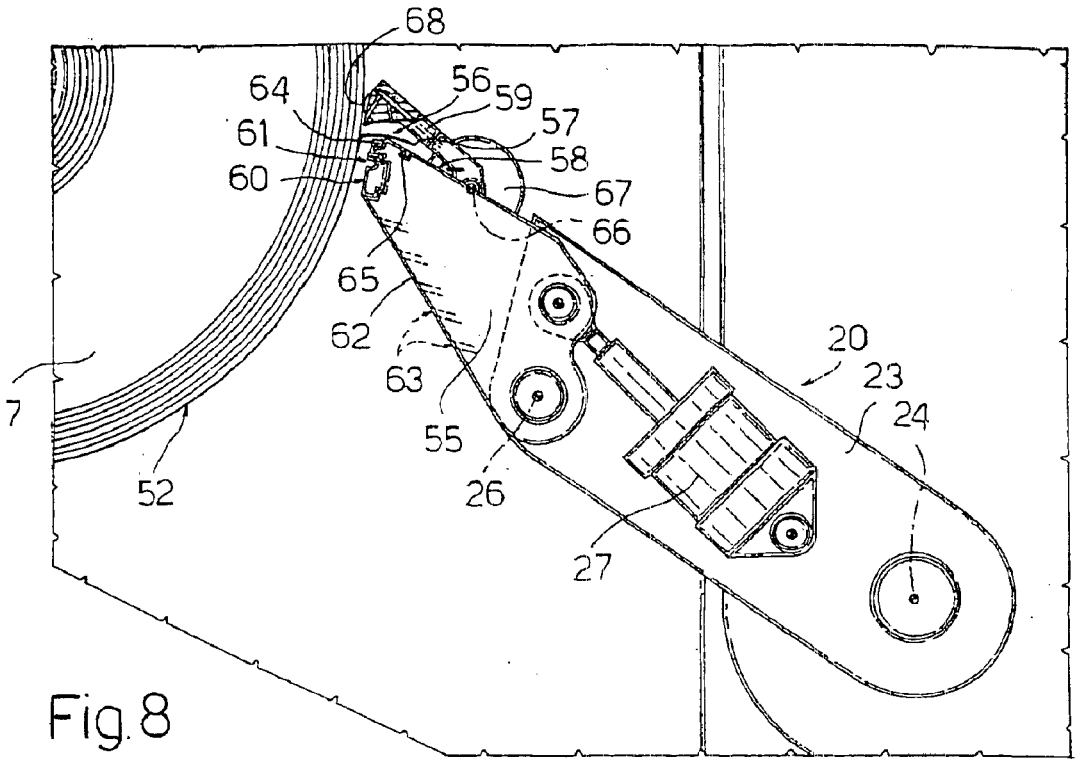
FIG. 8 shows a side view, with parts removed for clarity, of a variation of the FIG. 1 unit at one operating step.
Figure 9:
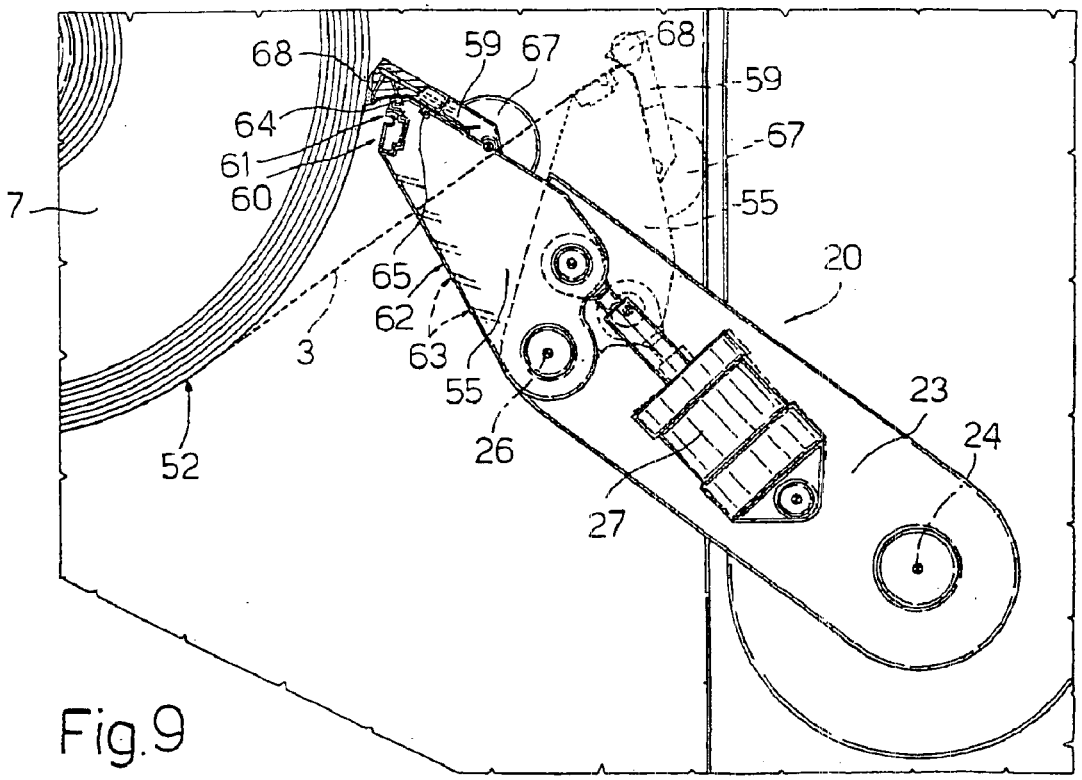
FIG. 9 shows a side view, with parts removed for clarity, of the FIG. 8 variation of the unit at further operating steps.

In the FIGS. 8 and 9 variation, unit 1 comprises a gripping head 55 in place of gripping head 25, and strip 3 has an end 56 with a colored adhesive tag 57 for keeping the free end 56 in contact with the cylindrical surface 52 of the new reel 7.

Gripping head 55 pivots about axis 26 with respect to arm 20, is activated by actuator 27 in the same way as gripping head 25, and comprises a gripping face 58, along which head 55 supports a jaw 59; a cutting face 60 having a groove 61 and cooperating with tools 17 and 18; and a face 62 along which oriented holes 63 are distributed. Pace 60 is adjacent, on one side, to face 58 and, on the opposite side, to face 62, and forms an acute angle with face 58 and an obtuse angle with face 62. Gripping head 55 also comprises an optical sensor 64 along cutting face 60, and an optical sensor 65 along gripping face 58, and both sensors 64 and 65 are located at the edge between gripping face 58 and cutting face 60, along which suction holes (not shown) are provided.

Figure 10:
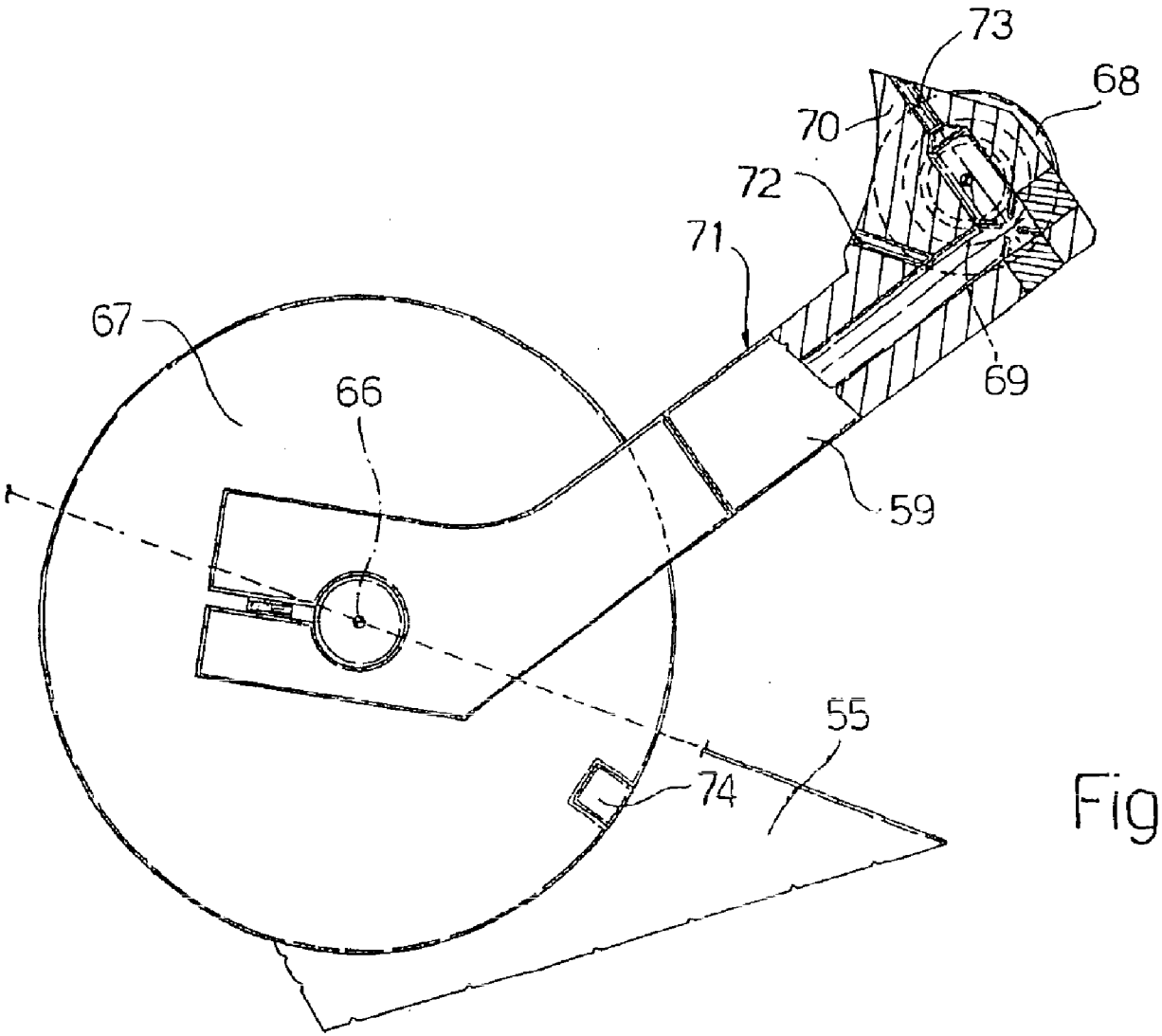
FIG. 10 shows a partly sectioned, larger-scale side view of a detail in FIG. 8.

As shown more clearly in FIG. 10, jaw 59 pivots with respect to head 55 about an axis 66 parallel to axis 26, and comprises, and is activated by, a rotary piston 67. Jaw 59 has a free end supporting two wheels 68 rotating about an axis 69 parallel to axis 26, and comprises a tip 70 projecting with respect to wheels 68; a face 71 which contacts end 56 to grip end 56 against gripping face 58; holes 72 located along gripping face 71 and selectively supplied with compressed air; and holes 73 located at tip 70 and selectively supplied with compressed air independently of holes 72. Gripping head 55 also comprises a sensor 74 to determine the angle formed by jaw 59 and gripping head 55.

In actual use, to pick up end 56, head 55 operates as follows, as of a situation in which jaw 59 is closed against gripping face 58, and gripping head 55 is some distance from reel 7. Gripping head 55 is rotated anticlockwise, in FIG. 8, about axis 26 to position cutting face 60 facing the cylindrical surface 52 of reel 7.

On approaching reel 7, wheels 68 of jaw 59 are brought into contact with surface 52, while actuator 27 continues rotating head 55 anticlockwise about axis 26 so as to detach jaw 59 from gripping face 58; and the rotation of gripping head 55 about axis 26 is arrested upon sensor 74 detecting a given angle between face 58 of head 55 and face 71 of jaw 59.

Once head 55 and jaw 59 assume the open-gripper conformation shown in FIG. 8, reel 7 is rotated in the winding direction, i.e. clockwise in FIG. 8; at which stage, rotary piston 67 acts as a gas spring to keep jaw 59 in contact with cylindrical surface 52 of reel 7. As the reel rotates, optical sensor 64 determines the position of colored tag 57, and control unit 10 arrests rotation of reel 7, with a given delay with respect to detection of the tag, and emits compressed-air jets from holes 73.

The jets emitted from holes 73 are tangent to and brush cylindrical surface 52 of reel 7 at end 56 to detach tag 57 and end 56 from cylindrical surface 52 and position end 56 between faces 58 and 71. At this stage, sensor 65 detects tag 57 between face 58 and jaw 59, and control unit 10 cuts off the jets from holes 73, activates compressed-air jets from holes 72 to keep end 56 in contact with face 58, and rotates the head clockwise about axis 26 to close the gripper defined by head 55 and jaw 59, as shown in FIG. 9.

At the same time, reel 7 is rotated in the unwinding direction, i.e. anticlockwise in FIG. 9, while head 55 rotates about axis 26 into the configuration shown by the dash line in FIG. 9. Unit 1 then positions end 56 at cutting tool 17, and the rotary piston opens the gripper by rotating jaw 59 clockwise in FIG. 9. Unit 1 then operates in the same way as in the FIGS. 1–6 embodiment. In addition to the advantages of the first embodiment of the present invention, the above variation also has the advantage of detaching end 56 without scraping the surface of reel 7, and with no need for a ballasted end.

What is claimed is:

1. A strip feed unit comprising pins (12) for supporting a first and a second reel (6, 7) of a first and a second strip (2, 3) respectively, the second reel (7) having a cylindrical outer surface (52), and an end (53; 56) of the second strip (3) extending at said cylindrical outer surface (52); the unit (1) comprising a movable arm (20) having a gripping head (25; 55) for gripping said end (53) along the cylindrical outer surface (52), and a first tool (18) having a plate (40) for joining the first and the second strip (2, 3); and the unit being characterized in that said gripping head (25; 55) comprises a first gripping face (30; 60) for gripping said first and said second strip (2, 3) between the plate (40) and said first gripping face (30; 60).

2. A unit as claimed in claim 1, characterized by comprising a second tool (17) for cutting a portion (22) of said second strip (3); said second tool (17) being movable between a rest position and a work position; and said second tool (17), in said work position, being positioned substantially contacting said first gripping face (30; 60).

3. A unit as claimed in claim 2, characterized in that said gripping head (25; 55) comprises a groove (31; 61) located along said first gripping face (30; 60); said second tool (17) comprising a heatable edge (36) for engaging said groove (31) to detach said portion (22) from the second strip (3).

4. A unit as claimed in claim 3, characterized in that said gripping head (25; 55) comprises a second gripping face (28; 58) having means for retaining said end (53).

5. A unit as claimed in claim 4, characterized in that said second gripping face (28; 58) is adjacent to the first gripping face (30; 60) and forms a sharp edge with the first gripping face (30; 60).

6. A unit as claimed in claim 5, characterized by comprising an adjusting device (19) for adjusting the position of the second strip (3).

7. A unit as claimed in claim 6, characterized in that said adjusting device (19) comprises a channel (49) for feeding the second strip (3); and first sensors (46) for detecting the position of reference points (54) on the second strip (3).

8. A unit as claimed in claim 7, characterized in that said adjusting device (19) comprises a wall (42); and a movable arm (43) cooperating with said wall (42) to form said channel (49).

9. A unit as claimed in claim 8, characterized in that said first sensors (46) are located along said wall (42).

10. A unit as claimed in claim 9, characterized in that said wall (42) comprises oriented holes (45) to blow air through said oriented holes (45) and assist the travel of the second strip (3) through said channel.

11. A unit as claimed in claim 10, characterized in that said gripping head (25; 55) comprises further oriented holes (33; 63) to blow air through said further oriented holes (33; 63) and assist the travel of said second strip (3) resting on said gripping head (25; 55).

12. A unit as claimed claim 11, characterized in that said first tool (18) is movable between a work position and a rest position, and comprises a further heatable edge (39) for cutting said first strip (2); said further heatable edge (39) being movable with respect to said plate (40).

13. A unit as claimed in claim 12, characterized by comprising second sensors (51) for detecting the position of the first strip (2) at said first tool (18).

14. A unit as claimed in claim 12, characterized by comprising third sensors (50) for detecting the diameters of the first and second reel (6, 7).

15. A unit as claimed claim 14, characterized in that said arm (20) rotates about a first axis (24) parallel to said pins (12); said gripping head (25; 55) rotating with respect to said arm (20) about a second axis (26) parallel to said first axis (24).

16. A unit as claimed claim 15, characterized in that said gripping head (55) comprises a jaw (59) rotating about a third axis (66) and cooperating with said second gripping face (58) to retain said end (56).

17. A unit as claimed in claim 16, characterized in that said jaw (59) comprises first holes (73) for detaching said end (56) from said cylindrical surface (52) by means of compressed-air jets through said first holes (73); said end (56) comprising an adhesive tag (57) for keeping said end (56) in contact with said cylindrical surface (52).

18. A unit as claimed in claim 16, characterized in that said gripping head (55) comprises at least one optical sensor (64, 65) for detecting said tag (57).

19. A unit as claimed in claim 17, characterized in that said jaw comprises second holes (72) for blowing in compressed air and positioning said end (56) on the second gripping face (58).

20. A method of feeding strips to an automatic machine by means of a unit comprising pins (12) for supporting a first and a second reel (6, 7) of a first and a second strip (2, 3), the second reel (7) having a cylindrical outer surface (52), and an end (53) of said second strip (3) extending at said cylindrical outer surface (52); an arm (20) having a gripping head (25; 55); and a first tool (18) having a plate (40) for joining the first and the second strip (2, 3); the method being characterized by comprising the steps of positioning said gripping head (25; 55) in contact with said end (53; 56); picking up said second strip (3) by means of said gripping head (25; 55); and gripping the first and the second strip (2, 3) between the plate (40) of said first tool (18) and said gripping head (25; 55).

21. A method as claimed in claim 20, characterized in that said gripping head (25; 55) comprises a first gripping face (30; 60); said first and second strip (2, 3) being gripped between said first gripping face (30; 60) and the plate (40) of said first tool (18).

22. A method as claimed in claim 20, characterized by comprising the steps of positioning said gripping head (25; 55) close to said cylindrical outer surface (52) of the second reel (7); and rotating the second reel (7) so that said gripping head (25; 55) intercepts said end (53; 56).

23. A method as claimed in claim 22, characterized in that said end (53) is ballasted.

24. A method as claimed claim 22, characterized by comprising the steps of inserting said end (53; 56) inside a channel (49), and feeding said second strip (3) along said channel (49).

25. A method as claimed in claim 24, characterized by comprising the step of detecting the position of said second strip (3) by means of first sensors (46) located along said channel (49).

26. A method as claimed in claim 24, characterized by comprising the step of supporting said second strip (3) by means of said gripping head (25; 55) as the second strip is fed along said channel (49).

27. A method as claimed in claim 26, characterized by comprising the step of cutting a portion of said second strip (3) by means of a second tool (17) cooperating with said gripping head (25; 55).

28. A method as claimed in claim 27, characterized by comprising the step of detecting the diameters of the first and second reel (6, 7).

29. A method as claimed in claim 28, characterized by detecting the position of the first strip (2) at said first tool (18).

30. A method as claimed in claim 29, characterized by comprising the step of cutting said second strip (3) by means of said first tool (18) cooperating with said gripping head (25; 55).

* * * * *